United States Patent [19]

Englert

[11] Patent Number: 4,993,464

[45] Date of Patent: Feb. 19, 1991

[54] WOODWORKING MACHINE, ESPECIALLY GROOVING MACHINE

[75] Inventor: Heiner Englert, Lauda-Konigshofen, Fed. Rep. of Germany

[73] Assignee: Michael Weinig Aktiengesellschaft, Tauberbischofsheim, Fed. Rep. of Germany

[21] Appl. No.: 418,017

[22] Filed: Oct. 6, 1989

[30] Foreign Application Priority Data

Oct. 7, 1988 [DE] Fed. Rep. of Germany ... 8812624[U]

[51] Int. Cl.[5] ..... B27C 5/00

[52] U.S. Cl. ..... 144/136 R; 29/568; 83/481; 144/2 R; 144/3 R; 144/368; 144/371; 409/158

[58] Field of Search ..... 83/479, 480, 481; 408/18; 29/568; 409/157, 158, 138, 172, 173, 204, 205, 226; 144/1 R, 1 G, 2 R, 3 R, 134 R, 136 R, 368, 371

[56] References Cited

U.S. PATENT DOCUMENTS

| | | | |
|---|---|---|---|
| 3,727,503 | 4/1973 | Braner et al. | 83/481 |
| 4,354,798 | 10/1982 | De Muynck | 144/136 R |
| 4,563,930 | 1/1986 | Schommler et al. | 83/479 |
| 4,842,029 | 6/1989 | De Abreu | 144/136 R |

*Primary Examiner*—W. Donald Bray
*Attorney, Agent, or Firm*—Robert W. Becker & Associates

[57] ABSTRACT

A woodworking machine, especially grooving machine, including spindles that carry working tools, especially cutter heads, and also including at least one feed unit via which pieces of wood that are to be worked are transported through the machine in a direction of transport. The machine also has at least one carrier that can be shifted transverse to the direction of transport of pieces of wood through the machine and that carries two of the working tools, with these two tools being selectively shiftable via the carrier into an operating position and a rest position.

15 Claims, 3 Drawing Sheets

WOODWORKING MACHINE, ESPECIALLY GROOVING MACHINE

BACKGROUND OF THE INVENTION

1. Field of the Invention

The present invention relates to a woodworking machine, especially a grooving machine, including spindles that carry working tools, especially cutter heads, and also including at least one feed unit via which pieces of wood that are to be worked are transported through the machine in a direction of transport.

2. Description of the Prior Art

Grooving machines are known that in the direction of transport of the pieces of wood are provided one after the other with a right, a left, an upper, and a lower spindle, each of which carries a cutter head. Consequently, as the pieces of wood pass through the grooving machine they are successively worked on the right, on the left, on the upper, and on the lower side. If, for example, the blades of one of these cutter heads have to be replaced or reconditioned, it is necessary to shut the machine down during this time. Down times are therefore relatively great. Even when an entire cutter head has to be replaced, the heretofore known grooving machine must be shut down.

It is therefore an object of the present invention to improve a woodworking machine of the aforementioned general type in such a way that down times for working on the machine can be kept to a minimum.

BRIEF DESCRIPTION OF THE DRAWINGS

This object, and other objects and advantages of the present invention, will appear more clearly from the following specification in conjunction with the accompanying schematic drawings, in which:

FIG. 1 is a plan view of one exemplary embodiment of the inventive woodworking machine;

SUMMARY OF THE INVENTION

Figure 2:
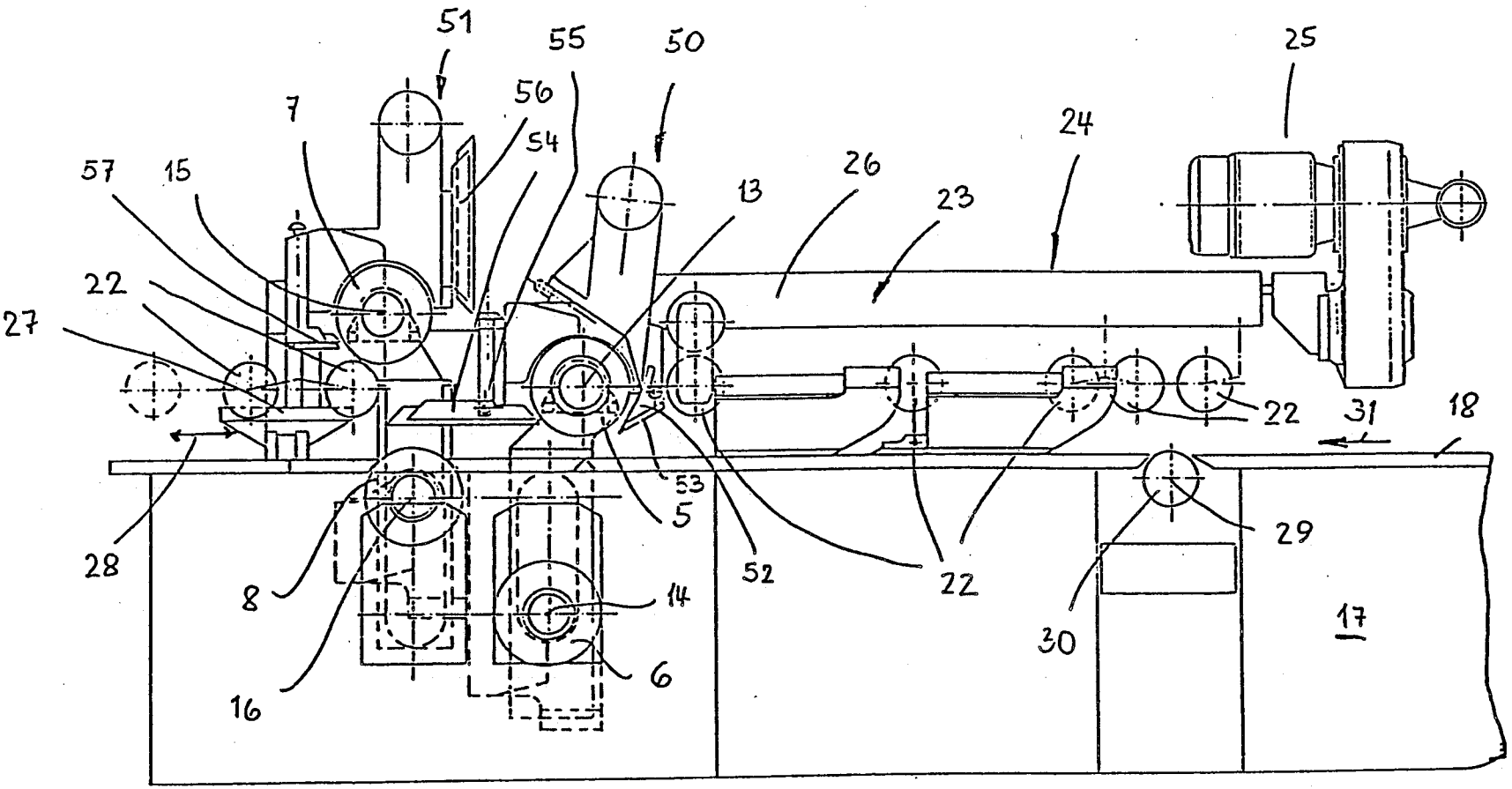
FIG. 2 is a side view of the woodworking machine of FIG. 1.
Figure 3:
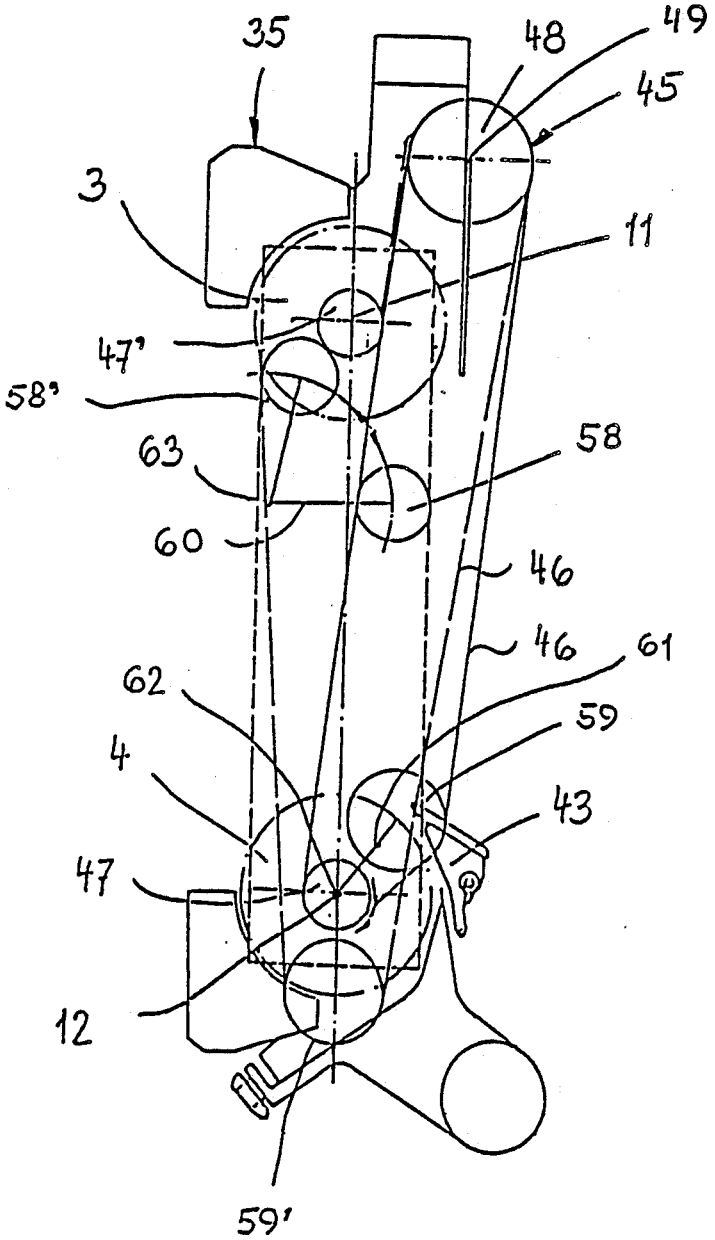
FIG. 3 is a view that shows one exemplary embodiment of a drive means for a working spindle of the inventive woodworking machine.
Figure 3:
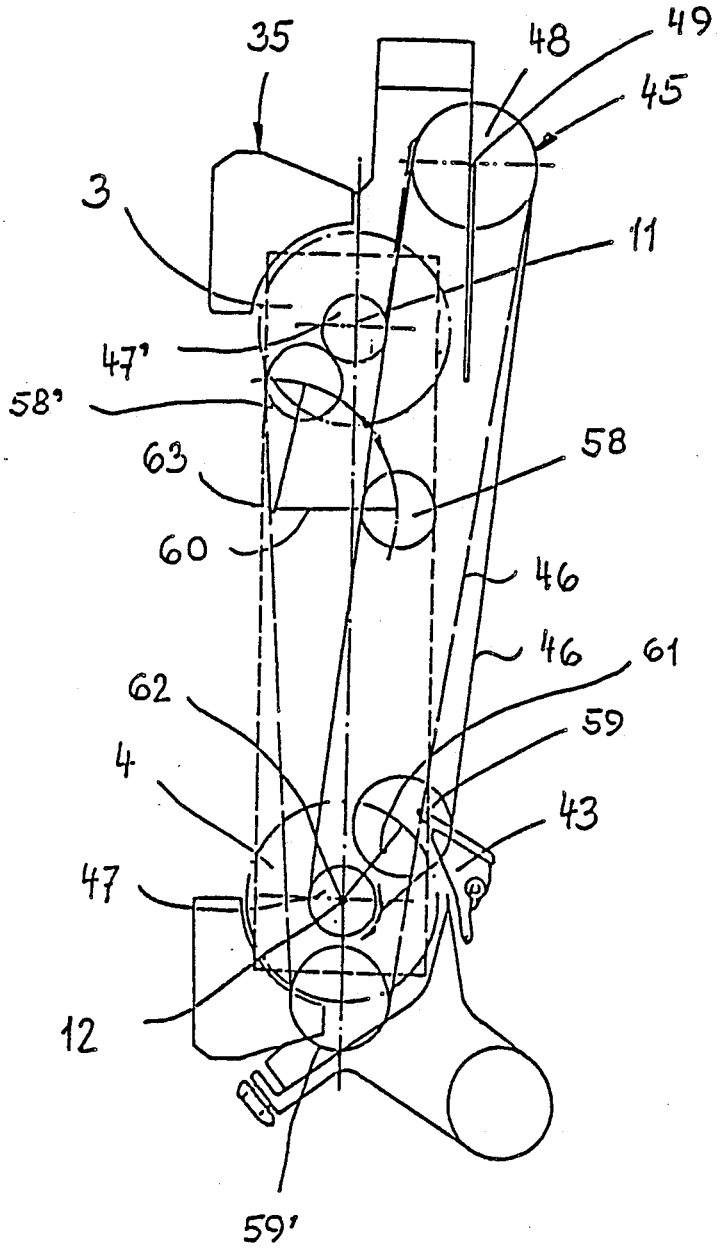

The woodworking machine of the present invention is characterized primarily by at least one carrier means that is shiftable transverse to the direction of transport of pieces of wood and that carries two of the working tools, with these two working tools being selectively shiftable via the carrier means into an operating position and a rest position.

Via the inventive carrier means that can be shifted transverse to the direction of transport of pieces of wood through the machine, the two working tools that are carried by the carrier means can be shifted into an operating position or a rest position. As long as one of the working tools is in the operating position, work that has to be done on the other working tool, which is in the rest position, can be undertaken without having to shut down the woodworking machine or having to interrupt the passage of pieces of wood through the machine. Therefore, for example, the blades of the working tool that is in the rest position can be replaced or reconditioned. A replacement of the entire cutter head is also readily possible. During this process, it is not necessary to interrupt the working of the pieces of wood. The down times of the inventive woodworking machine are then required only for adjustment of the carrier means. As a result, very high outputs can be achieved with the inventive woodworking machine.

Further specific features of the present invention will be described in detail subsequently.

DESCRIPTION OF PREFERRED EMBODIMENTS

Referring now to the drawings in detail, in the illustrated embodiment the woodworking machine is a grooving machine in which pieces of wood are worked. In order to work the pieces of wood, the grooving machine is provided with cutter heads 1 to 8, each of which is seated on a respective shaft or spindle 9 to 16. The spindles 9 to 12 inclusive are disposed vertically, whereas the spindles 13 to 16 inclusive are disposed horizontally. In FIG. 1, the horizontal spindles 13 to 16 are merely indicated by dot-dashed lines.

The grooving machine has a frame 17 on which is disposed a table plate 18 on which the pieces of wood are transported through the grooving machine. One longitudinal side of the table plate 18 is provided with abutment edge means 19 to 21 inclusive against which the pieces of wood rest as they pass through the grooving machine. Feed rollers 22 serve to transport the pieces of wood; these feed rollers are mounted on a carrier 23 of a feed unit 24. A drive motor 25 is provided on the feed unit 24 to drive the feed rollers 22. To conform to pieces of wood that have different thicknesses, the height of the carrier 23 can be adjusted. The carrier 23 is of two-part construction, including a carrier part 26 that is disposed in the region of the vertical spindles 9 to 12 inclusive, as well as a carrier part 27 that in the pass-through direction of the pieces of wood is disposed downstream of the horizontal spindles 13 to 16 (FIG. 1). The two carrier parts 26, 27, disposed in the regions of the vertical and horizontal spindles respectively, are coupled with one another, so that these two carrier parts 26, 27 can follow the movements of the carrier 23 of feed unit 24 to feed rollers 22 in a like manner. The carrier part 27 can be adjusted in the horizontal direction 28 relative to the carrier part 26. The feed unit 24 comprises two carrier parts 26, 27 that are shiftable relative to one another in the direction of transport 31 of the pieces of wood. When viewed in the direction of transport 31 of the pieces of wood, one of the two carrier parts 27 of the feed unit 24 is disposed downstream of at least one of the working tools 7, 8. One feed unit part 27 is shiftable in the direction of transport 31 of the pieces of wood. The two carrier parts 26, 27 of the feed unit 24 are coupled together for movement transverse to the direction of transport 31 of the pieces of wood.

Disposed in the region below the first two feed rollers 22 (as viewed in the pass-through direction through the grooving machine) is a horizontally disposed spindle 29 with a dressing or planing tool 30 with which the pieces of wood are planed on the underside as they enter the grooving machine. To allow the planing tool 30 to extend through, the table plate 18 has an open area. Downstream of the planing tool 30 in the direction of pass-through, the grooving machine is provided with a slide unit 32 that is adjustable horizontally, i.e. transverse to the direction of transport 31 of the pieces of wood, and that carries the two vertical spindles 9 and 10 with the cutter heads 1 and 2. In addition, the slide unit 32 carries the drive members necessary for driving the spindles 9 and 10, as well as presser elements for the pieces of wood that are passing through. The slide unit 32 can be shifted between two end positions, so that either the spindle 9 or the spindle 10 can be used to work the pieces of wood. In the one end position illustrated in FIG. 1, the cutter head 1 works the right side of the pieces of wood as viewed in the direction of pass-through. In this case, the cutter head 1 extends through between the two abutment edge means 19 and 20. In the situation described, the other spindle 10 with the cutter head 2 is disposed in a rest or exchange position beyond the pass-through path and the table plate 18. In this rest position, the cutter head 2 can, for example, be replaced or can be provided with new blades, without having to interrupt working of the pieces of wood.

Associated with the cutter head 2 is a pressing shoe 33 that in the direction of transport 31 is disposed upstream of the cutter head. The pressing shoe 33 is provided with a vertical pressing surface 34 that is inclined toward the rear relative to the direction of transport 31. If the slide unit 32 is shifted into another or second end position, thereof; the cutter head 2 is then in a working position, while the cutter head 1 is then disposed beyond the transport path and the table plate 18. The cutter head 1, for example, can then be replaced. In the meantime the cutter head 2 is in a position to work the left side of the pieces of wood as viewed in the direction of transport 31. The pressing shoe 33 assures that the pieces of wood are satisfactorily pressed against the abutment edge means 19 and 20 as they pass by the cutter head 2.

The slide unit 32, on a side thereof that faces an adjacent slide unit 35, is provided with an abutment template 36 along which the pieces of wood can be guided as they pass through the grooving machine. The abutment template 36 has a guide surface 37 that is disposed parallel to the direction of transport 31 and that is provided on a carrier 38 having an approximately triangular contour. The carrier 38 can be folded back out of the position illustrated in FIG. 1 into a rest position about a non-illustrated horizontal shaft that is disposed perpendicular to the direction of transport 31. For this purpose, a non-illustrated drive means, for example in the form of a pneumatic cylinder, is provided on the slide unit 32. The abutment template 36 is provided at the level of the cutter head 2, so that it is not effective during operation of the cutter head 1.

The slide unit 35, which has essentially the same construction as does the slide unit 32, is disposed downstream of the latter in the direction of transport 31. The slide unit 35 carries the two vertical spindles 11, 12 with the cutter heads 3, 4 and the corresponding drive elements and pressing elements. The slide unit 35 can similarly be horizontally shifted between two end positions in the direction perpendicular to the direction of transport 31. In the one end position illustrated in FIG. 1, the cutter head 4 is in the working position and works the left side of the pieces of wood as they pass through. The other cutter head 3 is again disposed in the rest or servicing position. The slide unit 35 is similarly provided with an abutment template 39, which is provided on that side that faces the slide unit 32 and has a carrier 40 with an approximately triangular contour. On that longitudinal side that faces the table plate 18, the abutment template 39 carries two spaced-apart pressing rollers 41 and 42 that are freely rotatable about vertical shafts. As the pieces of wood pass through, the pressing rollers 41, 42 rest against the left side of the pieces of wood and press them firmly against the abutment edge means 19 and 20. In the operating position illustrated in FIG. 1, the pressing rollers 41, 42 are disposed at the level of the cutter head 1 in its operating position. As a result, the pieces of wood are satisfactorily guided in this area.

Downstream of the pressing rollers 41, 42 and upstream of the cutter head 4, when viewed in the direction of transport 31, the slide unit 35 is provided with a pressing shoe 43, the pressing surface 44 of which is inclined toward the rear in the direction of transport 31 and is inclined in the transport path. Just as is the pressing surface 34, the pressing surface 44 is disposed in a vertical plane.

Schematically illustrated on the slide unit 35 in FIG. 1 is the drive means for the two spindles 11 and 12. A belt drive 45 serves as the drive means, with the belt 46 thereof being guided about a pulley 47 on the vertical spindle 12 and about a pulley 48 on a drive shaft 49 of a non-illustrated motor. The belt 46 and the appropriate spindles and shafts are disposed on the slide unit 35 in such a way that the spindle 11 can be brought into contact with one run of the belt 46. For this purpose, it is possible, for example, to make either the spindle 11 or the drive shaft 49 adjustable on the slide unit 35, so that the belt 46 can be tensioned against the spindle and drive the same in the operating position of the cutter head 3.

The cutter heads 1 and 2 of the slide unit 32 can be rotatably driven in a similar manner. In place of the belt drive, the cutter heads could also be driven by any other suitable drive means, such as a gear or chain drive.

The horizontal spindles 13 to 16 (FIG. 2) are similarly mounted on slide unit s 50 and 51. To facilitate illustration, these slide units are not shown in FIG. 1, and similarly, the slide units 32 and 35 are not shown in FIG. 2. The slide units 50 and 51 can be shifted vertically between two end positions perpendicular to the direction of transport 31. The slide unit 50 with the cutter heads 5 and 6 as well as the horizontal spindles 13 and 14 is disposed in its lower end position, so that the cutter head 5 assumes its working position, in which it works the upper side of the pieces of wood that are passing through. The lower cutter head 6 assumes its rest or servicing position, in which, for example, the lower cutter head 6 can be exchanged or its blades can be replaced or reconditioned. To drive the cutter heads or spindles, it is again possible to use a belt drive, gear drive, chain drive, etc. The drive means and pressing elements are again provided on the slide unit 50. As with the slide units 32 and 35, these components can be adjusted precisely relative to one another as long as one of the cutter heads is in the operating position and works the pieces of wood that are passing through. Disposed directly upstream of the cutter head 5 in the direction of transport 31 on the slide unit 50 is again a pressing shoe 52, the pressing surface 53 of which is inclined downwardly in the direction of transport 31 and extends toward the front. The pressing shoe 52 rests via this pressing surface 53 on the upper side of the pieces of wood that are passing through and holds them firmly on the table plate 18. The pressing shoe 52 is provided on that side of the slide unit 50 that faces the slide units 32, 35. On the opposite side, the slide unit 50 is provided with a pressure shoe 54 that is pivotable about a horizontal shaft 55 that is disposed perpendicular to the direction of transport 31. If the cutter head 5 is in its operating position as illustrated in FIG. 2, the pressure shoe 54 is then pivoted downwardly into the horizontal position, so that it rests upon the upper side of the pieces of wood that are passing through and presses the same firmly against the table plate 18 during working via the cutter heads. The pressure shoe 54, for example, can be pivoted by a non-illustrated pneumatic cylinder that is similarly disposed on the slide unit 50. In the operating position, the pressure shoe 54 is disposed directly downstream of the cutter head 5 in the direction of transport 31, and in the region above the following cutter head 8. The pressure shoe 54 is expediently embodied in such a way that the height thereof can be adjusted.

In the illustration of FIG. 2, the slide unit 51 is disposed in its upper end position in which the cutter head 0 assumes its operating position and the underside of the pieces of wood that are passing through is worked. The slide unit 51 is essentially embodied in the same way as the slide unit 50, and is also provided with a pressure shoe 56 that is provided on that side of the slide unit 51 that faces the slide unit 50 and that is also pivotable about a horizontal shaft. Since the slide unit 51 is disposed in its upper end position, the pressure shoe 56 is pivoted into its vertical rest position and is not effective. In its rest position, the pressure shoe 56 is disposed in the region above the pressure shoe 54. Since each of the two pressure shoes 54 and 56, which are disposed on facing sides of the slide units 50 and 51, are pivotable about horizontal shafts that extend perpendicular to the direction of transport 31 the slide units 50, 51 can be disposed relatively close to one another on the grooving machine. If the slide units 50, 51 are to be shifted, the pressure shoes 54, 56 are first pivoted into the vertical rest position so that the slide units can be moved past one another.

On that side remote from the slide unit 50, the slide unit 51 is provided with a further pressure shoe 57 that is shorter than the pressure shoe 56 and is disposed directly downstream of the cutter head 7 in the direction of transport 31. The pressure shoe 57 is merely adjustable in height, and is not pivotable about a horizontal shaft.

The spindles 9 and 10 and 11 and 12 on the slide units 32 and 35 are disposed in a common vertical plane that is disposed perpendicular to the direction of transport 31. In contrast, the spindles 13, 14 and 15, 16 of the slide units 50 and 51 are slightly offset relative to one another in the direction of transport 31. In this connection, the spindles 13 and 16 are each disposed closer to the slide unit 35 than are the other spindles 14 and 15 on the two slide units 50 and 51 (FIG. 1). It should be noted, however, that it would also be readily possible to dispose the pairs of spindles of the slide units 50 and 51 in respective common planes.

With the positions of the slide units 32, 35, 50, and 51 illustrated in FIGS. 1 and 2, the pieces of wood that are transported through the grooving machine, after being planed on their underside by the planing tool 30, are first worked on their right side by the cutter head 1, then on their left side by the cutter head 4, then on their upper side by the cutter head 5, and finally on their underside by the cutter head 8. When the pieces of wood leave the grooving machine, all four sides thereof have been worked to the desired extent. The abutment template 39, which is disposed across from the cutter head 1, can be adjusted transverse to the direction of transport 31 to conform to varying widths of the pieces of wood, so that the pieces of wood are reliably pressed against the abutment edge means 19, 20 by the pressing rollers 41, 42. In the region of the vertical spindles the pressing rollers 41, 42 and the pressing shoe 43 are spaced only slightly one after the other, so that the pieces of wood are reliably guided on this side during the working. Also in the region of the horizontal spindles the pieces of wood are satisfactorily guided by the closely arranged elements 52, 54. In addition, the feed rollers 22 assure that the pieces of wood are pressed against the table plate 18 and are thereby reliably guided. As shown in FIG. 2, the carrier part 27 is moved into its right end position, so that in FIG. 2 the right feed roller 22 of the carrier part is disposed in the region above the cutter head 8, which is in the working position. As a result, the distance between this feed roller 22 and the preceding pressure shoe 54 in the direction of transport 31 is also slight, so that also in this region the pieces of wood are satisfactorily guided and transported.

The slide units 32, 35, 50, and 51 are satisfactorily shiftable in a horizontal and vertical direction transverse to the direction of transport 31 in non-illustrated guide means of the grooving machine. In the most straightforward case, the slide units, as previously described, are shifted into two end positions, so that a precise positioning of the respective cutter heads is possible in a simple manner. Pursuant to one preferred approach of the present invention, however, the slide units 32, 35, 50, and 51 are shifted by positioning motors that enable a precise shifting of the slide units. As a result, a precise adaptation to different thicknesses and heights of the pieces of wood is possible in a straightforward manner.

If, for example, the blades of the cutter heads 1 and 4 are to be reconditioned, it is then merely necessary to shift the slide units 32 and 35 in such a way that the other cutter heads 2 and 3 are in the operating position. Work can then be further accomplished with the grooving machine, while the blades of the cutter heads 1 and 4, which are in the rest position, are reconditioned. When the slide units 32 and 35 are shifted, the abutment templates 36 and 39 are folded up. When the cutter head 2 is in its operating position, the abutment template 36 can then be folded down, whereupon it is disposed across from the cutter head 3. The pieces of wood that pass through the grooving machine when the slide units 32, 35 are in this position are first worked on the left side and are subsequently worked on the right side.

In a similar manner, the slide units 50 and 51 can be shifted, so that the respectively other cutter heads 6 and 7 are in the operating position. In this case, the pieces of wood are first worked on the underside with the cutter head 6 and are subsequently worked on the upper side with the cutter head 7.

The slide units 32, 35, 50, and 51 can be shifted independently of one another, so that the pieces of wood can be worked with the various cutter heads in many different ways. For example, it is possible to shift the cutter heads 1 and 3 into their operating positions, so that when the pieces of wood pass through they are worked by these two cutter heads on only the right side. It is also possible, for example, to adjust the slide units 50. 51 in such a way that the pieces of wood are worked on only the upper or lower side by the appropriate cutter heads. In this way, a great number of adjustment possibilities are provided. Furthermore, the grooving machine can be provided with further vertically and/or horizontally shiftable slide units, with appropriate cutter heads, so that the application possibilities of this grooving machine can be considerably increased.

Since two cutter heads, with the pertaining drive and pressing elements, are provided on each slide unit, the changeover or conversion times for the grooving machine are extremely short. While one cutter head is in the operating position and works pieces of wood that are passing through, repair work that may be necessary can be carried out on the other cutter head, which is in the rest or servicing position. In addition, in this rest position the cutter head, with the pressing elements, can be adjusted in such a way that during a later shifting of this cutter head into the operating position, it is merely necessary to shift the slide unit without then having to undertake positioning steps. In this manner, the down times for the grooving machine for such changeover processes can be kept to a minimum.

The carrier part 27, which is adjustable in the direction of transport, assures that also in the region of the slide unit 51 the pieces of wood can be reliably engaged and transported by the feed rollers 22. If the cutter head 7 is brought into its operating position, the carrier part 27 is first shifted to the left in FIG. 2 into the position indicated by dashed lines. The cutter head 7 can then be easily shifted into its operating position. If the pertaining slide units 32 and 35 and 50 and 51 each assume the same position, it is to be understood that the pressure shoes and abutment templates that are in the path of movement of the other slide unit are folded up.

The present invention is, of course, in no way restricted to the specific disclosure of the specification and drawings, but also encompasses any modifications within the scope of the appended claims.

What I claim is:

1. In a woodworking machine, including spindles that carry working tools, particularly cutter heads, and also including at least one feed unit via which pieces of wood that are to be worked are transported through said machine in a direction of transport, the improvement comprising:

at least one carrier means that is shiftable transverse to said direction of transport of pieces of wood through said machine and that carries two of said working tools, and means with which said two working tools are made selectively shiftable via said carrier means into an operating position and a rest position, one of said working tools always being in the operating position when the other of said tools is in the rest position and vice versa so that operation of the woodworking machine occurs without having to shut down employment of one of the working tools and without having to interrupt passage of pieces of wood through the machine since the one working tool in the rest position can be replaced or reconditioned while the working tool in the operating position continues in use and down times are reduced as required only for adjustment of the carrier means.

2. A machine according to claim 1, in which said carrier means is a slide unit.

3. A machine according to claim 1, in which said carrier means also carries drive means for said spindles.

4. A machine according to claim 1, in which said carrier means is provided with at least one abutment element for said pieces of wood.

5. A machine according to claim 4, in which said abutment element is an abutment template having an abutment surface that is disposed parallel to said direction of transport of said pieces of wood.

6. A machine according to claim 4, in which said abutment element is provided with at least two pressing rollers for said pieces of wood.

7. A machine according to claim 4, in which said abutment element is pivotable about a horizontal axis that is disposed essentially parallel to said pieces of wood and transverse to said direction of transport thereof.

8. A machine according to claim 4, in which an abutment element of one carrier means is coordinated with that working tool of an adjacent carrier means that is in an operating position.

9. A machine according to claim 1, in which said carrier means is provided with at least one pressing means for said pieces of wood.

10. A machine according to claim 9, which includes means for shifting said pressing means in a direction transverse to said direction of transport of said pieces of wood.

11. A machine according to claim 1, which includes four carrier means, two of which are shiftable in a horizontal direction essentially parallel to said pieces of wood, and two of which are shiftable in a vertical direction essentially perpendicular to said pieces of wood, with each of said carrier means being provided with two of said working tools.

12. A machine according to claim 1, in which said feed unit comprises two parts that are shiftable relative to one another in said direction of transport of said pieces of wood.

13. A machine according to claim 12, in which, when viewed in said direction of transport of said pieces of wood, one of said parts of said feed unit is disposed downstream of a last one of said working tools.

14. A machine according to claim 13, in which said one feed unit part is shiftable in said direction of transport of said pieces of wood.

15. A machine according to claim 12, in which said two parts of said feed unit are coupled together for movement transverse to said direction of transport of said pieces of wood.

* * * * *